United States Patent [19]

Swann

[11] 4,188,758

[45] Feb. 19, 1980

[54] BASE FOR MOVABLE WALL PARTS

[76] Inventor: Charles Swann, 2422 Eugenia Ave., Nashville, Tenn. 37211

[21] Appl. No.: 970,915

[22] Filed: Dec. 19, 1978

Related U.S. Application Data

[63] Continuation-in-part of Ser. No. 943,788, Sep. 20, 1978.

[51] Int. Cl.[2] ..... E04B 2/56

[52] U.S. Cl. ..... 52/241; 52/281

[58] Field of Search ..... 52/233, 242, 122, 281, 52/239, 241

[56] References Cited

U.S. PATENT DOCUMENTS

| | | | |
|---|---|---|---|
| 1,706,469 | 3/1929 | Swanson | 52/238 |
| 3,282,006 | 11/1966 | Halsey et al. | 52/122 |
| 3,411,252 | 11/1968 | Boyle | 52/122 |
| 3,453,789 | 7/1969 | Stephenson | 52/241 |
| 3,566,559 | 3/1971 | Dickson | 52/241 |
| 4,021,973 | 5/1977 | Hegg et al. | 52/239 |

FOREIGN PATENT DOCUMENTS

| | | | |
|---|---|---|---|
| 6803560 | 9/1969 | Netherlands | 52/242 |
| 225583 | 3/1969 | Sweden | 52/242 |

*Primary Examiner*—James L. Ridgill, Jr.
*Attorney, Agent, or Firm*—Abe Hatcher

[57] ABSTRACT

A unitary extendible post-panel structure adapted for anchoring or seating the bottom or floor end of wall panels includes screwdown threaded metal bolts, bars or rods which are spring-activated so as to hold the post-panels in place against a floor or like surface.

6 Claims, 8 Drawing Figures

BASE FOR MOVABLE WALL PARTS

CROSS REFERENCE TO RELATED APPLICATION

This is a continuation-in-part of Ser. No. 943,788, filed Sept. 20, 1978.

BACKGROUND OF THE INVENTION

1.Field of the Invention

This invention relates to panel construction. More particularly, it relates to a unitary extendible post-panel structure for seating wall panels and posts against a substantially flat or level surface such as a floor.

2. Description of the Prior Art

In my earlier copending application, I described end seal construction of adjacent panels by fixing a sealing post to the cylindrical concave center surface of a panel at an intersection or corner so as to engage the post with the concave central surfaces of other panels the end portions of which have been made to seat against the sealing post.

SUMMARY OF THE INVENTION

After extended investigation I have now found that it is possible to install the posts and panels securely against the floor or like surface by providing a unitary post-panel structure which comprises an extendible tubular end post, an adjoining panel and a base component or member including one or more plates, preferably of metal, which are screwed down via a bottom adjustable nut, square rectangular member, threaded rod arrangement and spring-activated against a floor or like surface in such a manner that adjacent panels may be set at a post at any direction up to 90 degrees from one another.

DESCRIPTION OF THE DRAWING AND OF THE PREFERRED EMBODIMENT OF THE INVENTION

For a better understanding of my invention reference will now be made to the drawing, in which, FIG. 1 depicts a plurality of panels assembled in partitioning arrangement.

Figures 1, 2, 3, 4, 5, 6, 7, 8:
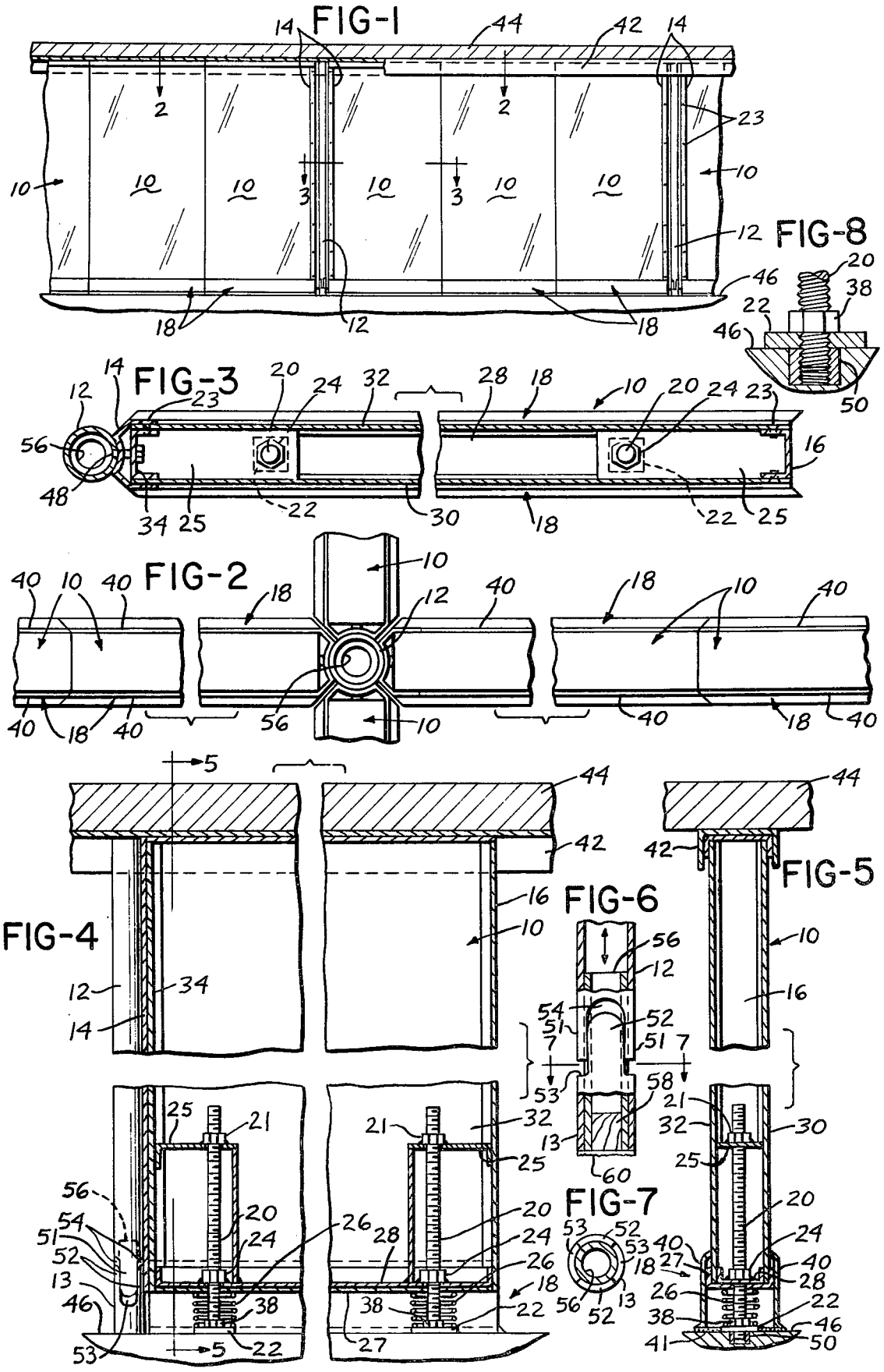
FIG. 2 is a top view taken at 2—2 of FIG. 1.
FIG. 3 is a sectional view taken at 3—3 of FIG. 1.
FIG. 4 is a longitudinal sectional view partially broken away, through a panel partition such as held against a floor or like substantially horizontal surface by the adjustable base assembly arrangement of the invention.
FIG. 5 is a lateral sectional view taken at 5—5 of FIG. 4.
FIG. 6 is a view of a portion of one of the posts shown partly in perspective and partly in section.
FIG. 7 is a sectional view taken at 7—7 of FIG. 6.
FIG. 8 is an enlarged view, partly in perspective and partly cross-sectional, depicting a bottom adjustable nut and associated square or rectangular member on a threaded rod at a floor or like surface, such as shown in less detail in FIG. 5.

In the drawing, a plurality of wall-type panels 10 fit integrally together with posts made up of adjustable upper members 12 and lower members 13 placed therealong at regular intervals, each unit being made up of a unitary post-panel structure such that the end of the panel opposite its post end fits against an adjoining post or the post of a unit via a rolled metal mating member 16. The panel 10 of each post-panel unit is joined at its post end in a unitary manner to the post of the unit by means of rolled metal pair members 48 and 14 and sleeve member 23. Panels 10 are positioned against a floor or like surface 46 by adjustable base assembly 18, the posts being made up of an extended shoulder 53-containing lower part 52, which is adjustable in cavity 54, and upper part 51. Center posts 56 cover the holes left when upper and lower parts 12 and 13 are adjusted so as to make the post of the height desired to match the height of the panel, which is adjusted by adjustable nuts on threaded rods, bars or screws 21 of base members explained hereinafter. A wooden plug 58 may be used at the bottom of the post in conjunction with a seal 60. Panels 10 fit in a ceiling channel 42 in ceiling 44.

In installing the base member 18, the panels may be laid down, or almost so, so that the threaded rods, bars or screws 21 can be easily inserted through holes through outside U-channels 27 and inside U-channels 28, which may be put in place first, and adjustments made by bottom adjustable nut 38. Square or rectangular member 22 may be turned to a "katty-corner" position so as to prevent base member 18 from being lowered during adjustment of nut 38. Optional threaded inserts 50 may be inserted below floor or like substantially level surface 46 to aid in secure installation. Seals 41 fit around bottom nuts 38 and squares 22 so as to prevent metal bases 40 from contacting floors or like surfaces 46. Springs 26 fit around the threaded rods, screws or bars 20 and bottom nuts 38 and extend between the U-channels 27 and 28 and the sqares 22 and floor or like surface 46. Stabilizers 25 may be used in conjunction with upper nuts 21 and lower nuts 24 spaced along and around threaded rods, screws or bars 20 as a supporting network for base assembly 18, including base 40, and surrounding side and end members 14, 16, 30, 32 and 34. Screws may be used to hold a "surround" or surrounding members, which fit around the sides and over the tops of the panels and may be welded at the top corners, in place against the stabilizers.

While the invention has been described in terms of preferred embodiments, the claims appended hereto are intended to encompass all embodiments which fall within the spirit of the invention.

Having thus described my invention and certain preferred embodiments thereof, I claim:

1. In a kit a base assembly for a unitary post-panel structure, said base assembly comprising as cooperative components thereof:

(1) a base member adapted to fit on the outside of the bottom of a panel, said panel having a cavity in the bottom thereof, (2) inside and outside U-channels for fitting inside and outside the bottom of said base member, (3) at least one threaded rod for fitting upward into said cavity in the bottom of said panel, (4) at least one nut spaced along each of said at least one threaded rod, (5) a spring adapted to fit around the lower part of said rod and extend downward from said U-channels to a firm surface to compress said base member against said firm surface and (6) a bottom adjustable nut adapted to space said base member and panel in a desired position with respect to one another when said base assembly is used in mounting panel.

2. The base assembly of claim 1 having additionally a rectangular member adapted to fit next to said bottom adjustable nut and be turned so as to prevent said base member from being lowered when said bottom nut is being adjusted.

3. The base assembly of claim 2 having additionally a seal adapted to seal the space around said rectangular member and said bottom adjustable nut, whereby metal is prevented from contacting said firm surface.

4. The base assembly of claim 1 with the components thereof assembled together at the bottom of a unitary post-panel structure comprising an adjustable post and an adjoining panel in unitary arrangement therewith as a single unit, said adjustable post comprising two adjustable components for adjusting the length of said post, one being a male member and another a female member, and having a center post to cover a hole left when said male member and female member do not fit completely together.

5. The base assembly of claim 4 wherein said unitary post-panel structure comprises said post and said adjoining panel joined together in a mating arrangement through a first mating member shaped to fit a joining surface contour of said post and a second mating member shaped to fit a joining surface contour of said adjoining panel.

6. The base assembly of claim 5 wherein said panel has a third mating member at its end opposite the end thereof joined to said post, said third mating member being shaped to fit a joining surface of an adjoining post adapted to fit thereagainst.

* * * * *